US005575666A

United States Patent [19]

Dent

[11] Patent Number: 5,575,666

[45] Date of Patent: Nov. 19, 1996

[54] ELECTRICAL CONTACTS

[75] Inventor: Peter Dent, Wimbledon, England

[73] Assignee: Smiths Industries Public Limited Company, London, England

[21] Appl. No.: 500,002

[22] Filed: Jul. 10, 1995

[30] Foreign Application Priority Data

Aug. 4, 1994 [GB] United Kingdom ..... 9415765

[51] Int. Cl.[6] ..... H01R 13/41

[52] U.S. Cl. ..... 439/82; 439/751

[58] Field of Search ..... 439/82, 751, 873

[56] References Cited

U.S. PATENT DOCUMENTS

| | | | |
|---|---|---|---|
| 4,469,394 | 9/1984 | Verhoeven | 439/873 |
| 4,606,589 | 8/1986 | Elsbree, Jr. et al. | 439/751 |
| 4,737,114 | 4/1988 | Yaegashi | 439/751 |
| 4,857,018 | 8/1989 | Pickles | 439/751 |
| 4,867,710 | 9/1989 | Harting et al. | 439/82 |
| 4,878,861 | 11/1989 | Kendall et al. | 439/751 |
| 5,122,075 | 6/1992 | Kile | 439/751 |

FOREIGN PATENT DOCUMENTS

| | | |
|---|---|---|
| 0325296 | 7/1989 | European Pat. Off. . |
| 1149332 | 4/1969 | United Kingdom . |

*Primary Examiner*—Gary F. Paumen

*Attorney, Agent, or Firm*—Pollock, Vande Sande & Priddy

[57] ABSTRACT

A compliant contact for insertion in a plated hole in a circuit board is machined from a single piece of metal with a shank at one end, which projects through the hole, and a socket at its opposite end, which can be crimped about a conductor inserted in it. Rearwardly of the shank, the contact has an entry region with two convex surfaces tapering away from one another rearwardly to a compliant region. The compliant region has two flat sides and a slot extending between the sides, which divides the region into two resilient blades, each of which has a flat, parallel outer surface. The flat outer surfaces are divided from the flat sides by turned edge portions formed as a part of a common surface of circular section.

11 Claims, 2 Drawing Sheets

ELECTRICAL CONTACTS

BACKGROUND OF THE INVENTION

This invention relates to electrical contacts.

The invention is more particularly concerned with compliant contacts for insertion into plated holes in printed circuit boards.

Compliant contacts can be used, instead of soldered pins, to make connection to plated-through holes in pcb's. A compliant contact can be removed more readily than a soldered pin and thereby facilitates maintenance. The problem with compliant contacts, however, is that repeated removal and insertion can damage the board and the plating of the hole. It can also be difficult to achieve a secure mechanical and electrical connection to the board without causing damage. This problem can be aggravated by relatively wide variations in diameter of the holes.

BRIEF SUMMARY OF THE INVENTION

It is an object of the present invention to provide an improved contact and an assembly including a contact.

According to one aspect of the present invention there is provided a compliant contact for insertion in a conductive hole in a circuit board, the contact including a forward shank region having a width less than the diameter of the hole, an entry region having two opposite convex surfaces tapering away from one another rearwardly of the contact, the width of the entry region between the convex surfaces being less than the diameter of the hole at its forward end and being greater than the diameter of the hole at its rearward end, the contact including a compliant region having two parallel flat sides, the compliant region being compliant along a part of its length and having a slot extending between the two flat sides to divide a part of the compliant region into two resilient blades, the slot extending longitudinally along a part of the compliant region and being spaced rearwardly of the entry region, the compliant region having a planar surface on the outer surface of each blade, the planar surfaces extending longitudinally along the compliant region, each planar surface being separated along opposite edges from the flat sides by four respective edge portions, and each of the four edge portions having a forward region that tapers outwardly and reduces in width rearwardly, and a rearward region of substantially constant width.

The compliant region preferably has non-compliant portions at opposite ends of the slot adapted for location within opposite ends of the hole. The planar surfaces are preferably flat and parallel. The edge portions may form parts of a common surface of circular section. The slot may be rounded at opposite ends and the contact may have a socket portion at the end opposite the shank region, the socket portion being of a material that can be crimped about a conductor inserted in the socket. The contact is preferably machined from a single piece of metal, such as phosphor-bronze.

According to a further aspect of the present invention there is provided a method of making a compliant contact including the steps of turning a metal blank to a circular section having a forward shank region with a width less than the diameter of the hole in which the contact is to be inserted, a tapered entry region extending from the shank region and a cylindrical compliant region extending from the entry region, machining two parallel flat sides to extend along the compliant region and the entry region, machining two parallel flat surfaces to extend at right angles to the flat sides along the compliant region, the sides being separated from the surfaces by turned edge regions, and forming an elongate slot between said sides to extend along a part of the compliant region so as to divide the part into two resilient blades.

The slot is preferably formed by stamping.

According to another aspect of the present invention there is provided a contact made by the method of the above further aspect of the invention.

According to yet another aspect of the present invention there is provided an assembly including a circuit board and a contact according to the above one or other aspect of the present invention inserted in a hole in the board.

The length of the slot is preferably less than the thickness of the board, the compliant region having non-compliant portions at opposite ends located in opposite ends of the hole.

According to one more aspect of the present invention there is provided a method of forming an assembly including the steps of: providing a circuit board having a conductive hole extending therethrough, forming a compliant contact including the steps of turning a metal blank to a circular section having a forward shank region with a width less than the diameter of said hole, a tapered entry region extending from the shank region and a cylindrical compliant region extending from the entry region, said compliant portion having a diameter greater than that of the hole, machining two parallel flat sides to extend along the compliant region and the entry region, machining two parallel flat surfaces to extend at right angles to the flat sides along the compliant region, the sides being separated from the surfaces by turned edge regions, forming an elongate slot between said sides to extend along a part of the compliant region so as to divide the part into two resilient blades, and pushing the forward shank portion through the hole from one side of the board so that it emerges from the other side leaving the compliant region located within the hole.

A printed circuit board assembly including an electrical contact in accordance with the present invention, will now be described, by way of example, with reference to the accompanying drawings.

DETAILED DESCRIPTION OF THE PREFERRED EMBODIMENT

Figure 1:
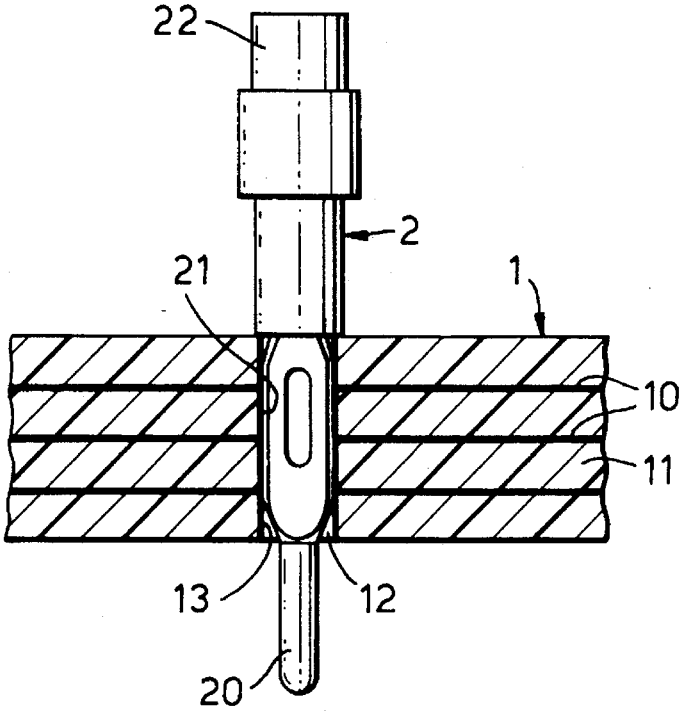
FIG. 1 is a sectional side elevation of the assembly with the contact inserted in the board.

With reference to FIG. 1, the assembly comprises a multi-layer printed circuit board 1 and one or more compliant contacts 2.

The board 1 is of conventional construction including several copper layers 10 insulated from one another by insulative layers 11 and connected with one another at plated-through, circular holes 12, only one of which is shown. The hole 12 has a conductive, plated coating 13 consisting of a layer of copper covered by a layer of tin-lead. Typically, the thickness of the board 1, and hence the length of the hole 12 is 4 mm, with the diameter of the hole being 1 mm.

Figure 2:
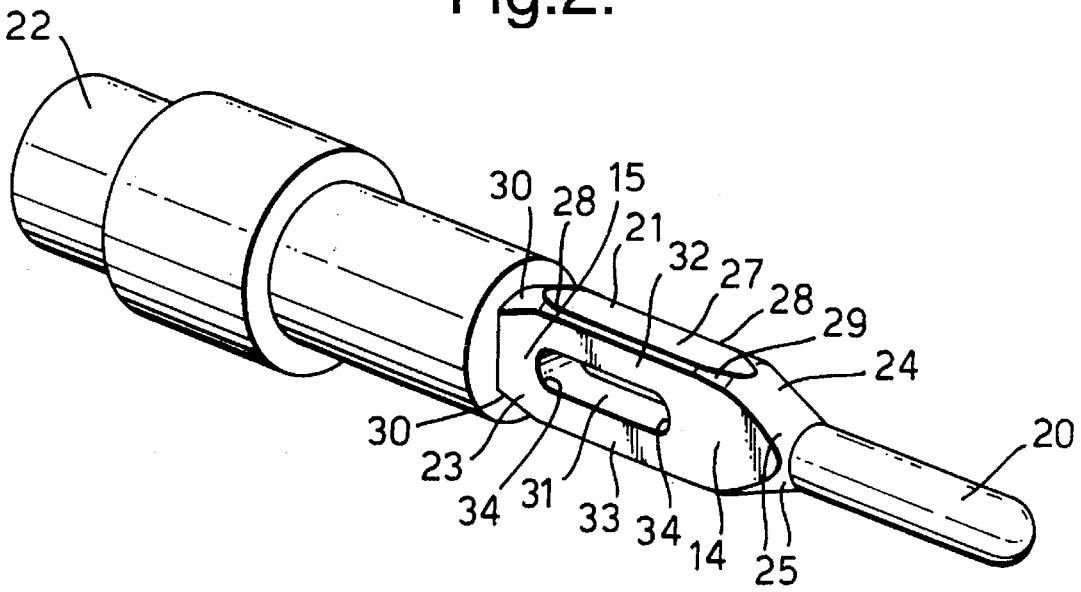
FIG. 2 is a perspective view of the contact.
Figure 3:
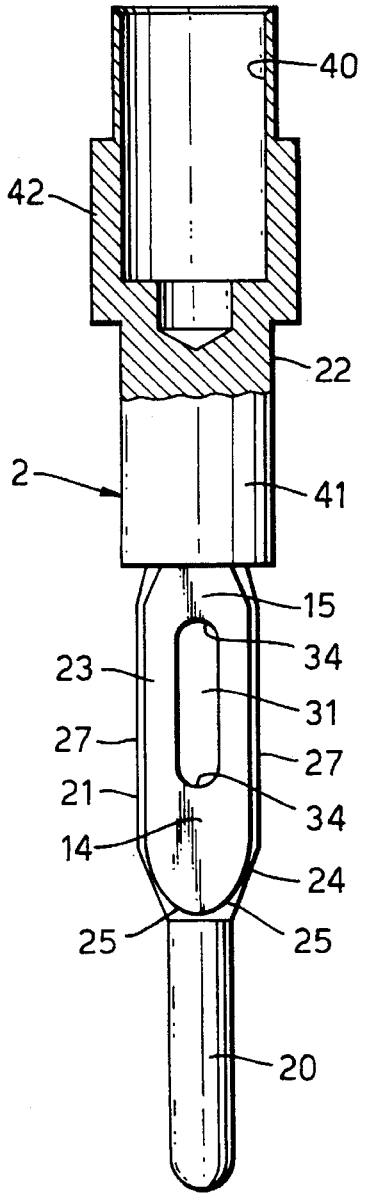
FIG. 3 is a part-sectional side elevation view of the contact.

With reference now also to FIGS. 2 and 3, the contact 2 is machined, in a manner described later, from a single piece of phosphor-bronze, such as Boillat BP5. The contact 2 is 11.53 mm long and includes a shank region 20, at its lower end, an intermediate compliant region 21 and a socket region 22, at its upper end. The shank region 20 is divided from the compliant region 21 by an entry region 24.

The shank region 20 is 2.36 mm long and of circular section with a diameter of 0.6 mm, that is, smaller than the hole 12. At its lower end, the shank region 20 is rounded.

The compliant region 21 is 2.65 mm long with a generally rectangular section. The compliant region 21 has two opposite flat sides 23 extending parallel to one another along the compliant region and the entry region 24 and separated from one another by a thickness of 0.62 mm. The compliant region 21 is 1.12 mm wide along the major part of its length, that is, slightly wider than the hole 12. At its lower, or forward end, the compliant region 21 joins with the entry region 24. The entry region 24 is 1.15 mm long, with two opposite convex surfaces 25 extending between the flat sides 23 and tapering away from one another rearwardly. The convex surfaces 25 taper from the shank region 20 at their forward, lower end, where the width of the entry region 24 is less than that of the hole 12, to the compliant region 21 where the width is 1.12 mm.

The compliant region 21 has two parallel, planar surfaces 27 extending longitudinally, rearwardly from the convex surfaces 25, at right angles to the flat sides 23. Between each flat surface 27 and each flat side 23 extends a respective edge portion 28 of convex shape, which form a part of a common surface of circular section. At their lower, forward end 29, the four edge portions 28 taper outwardly and reduce in width rearwardly. Along the rear, major part of their length, the four edge portions 28 are of a constant narrow width, being about 0.05mm, and are straight, extending parallel to one another. At their upper, rear end, the edge portions 28 communicate with two convex regions 30 that taper inwardly and extend rearwardly from the flat surfaces 27.

The compliant region 21 has a slot 31 stamped through the flat sides 23 centrally across their width to divide a part of the region into two generally parallel resilient blades 32 and 33 and thereby render this part of the region compliant. The slot 31 is 0.30 mm wide and 2.2 mm long. Opposite ends of the slot 31 are formed with rounded C-shape regions 34, although in an alternative arrangement the ends of the slot could be of V-shape. The center of the slot 31 is located at a point 1.65 mm below the upper, rear end of the compliant region 21. The forward end of the slot 31 is spaced above the entry region 24 by a gap so that the forward portion 14 of the compliant region 21 is solid and is not compliant. Similarly, the rear end of the slot 31 is spaced from the rear end of compliant region 21 by a solid portion 15 so that the rear end of the compliant region is also non-compliant. In this way, two non-compliant portions are provided at opposite ends of the compliant region beyond the slot.

The socket portion 22 is 5.45 mm long and of cylindrical shape. The lower, forward end 41 of the socket portion 22 is solid and is 2.40 mm long with a diameter of 1.45 mm. The rear end 42 of the socket portion 22 is 3.05 mm long and has an external diameter of 2.02 mm at its lower end, which steps to a smaller diameter of 1.57 mm about halfway along its length. A bore 40 extends into the upper, rear end 42 of the socket portion 22, the bore being 1.42 mm in diameter and about 2.65 mm long.

The assembly is made by inserting the shank portion 20 of the contact 2 in the hole 12 in the board 1 and pushing the contact down until the entry region 24 contacts the upper edge of the hole. The curvature of the convex surfaces 25 is chosen to be substantially the same as that of the edge of the hole 12 so that the load on the edge of the hole is distributed over a large area, thereby reducing the risk of damage to the hole and its plating in the upper layer of the broad.

As the contact 2 is pushed down further, the edge of the hole 12 is contacted by the edge portions 28 instead of the convex surfaces 25. The lower ends 29 of the edge portions 28 decrease in width and increase in radial distance from the axis of the contact. This creates a furrow in the plating of the hole that increases gradually in depth as the contact is inserted. The gradual decrease in the cross-sectional area of the contact that contacts the hole 12 means that the plating of the hole is polished and spread rather than cut. The solid, forward end 14 of the compliant region 21 effectively broaches or sizes the diameter of the hole 12 so that the diameter of the hole becomes more closely matched to the dimensions of the contact. This corrects variations in diameter of the hole or thickness of its plating. The effect of this is that the correct contact force is exerted by the resilient blades 32 and 33 on the bore of the hole, ensuring a good electrical contact. It also eliminates large variations in extraction force and ensures that the contacts are firmly retained in the board. Furthermore, because the shape of the contact relies on friction to retain it in the hole rather than a high radially-directed resilient force, the damage to the hole, and to the board in the region of the hole, is minimized.

When fully inserted, the entire length of the compliant region 21 is located in the hole 12, with the solid lower and upper portions 14 and 15 located at opposite ends of the hole. These solid portions 14 and 15 are a close fit in the hole and ensure that the contact 2 cannot rock laterally, as would be the case if the entire length of that part of the contact in the hole were compliant. The socket portion 22 projects above the upper surface of the board 1 and the shank 20 projects below the lower surface. Connection is made to the upper end of the contact 2 by inserting the end of a wire or other conductor into the bore 40 of the socket portion 22 and then crimping it about the wire so that the wire is engaged electrically and mechanically. This establishes electrical connection between the wire and the board 1. In alternative contacts, connection could be made to the shank 20 such as by wrapping a wire around the shank and soldering it in position. It will be appreciated, however, that the contact could be differently formed at its ends so that connection could be made to the contact in different ways.

Figure 4:
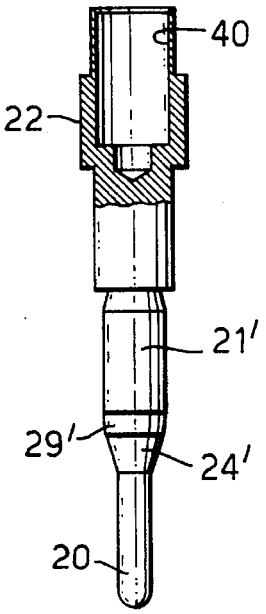
FIG. 4 is a side elevation view of the contact at a preliminary stage of manufacture.

The contact 2 is made by turning a blank of phosphor-bronze to the shape shown in FIG. 4, which is of circular section along its entire length. The turning operation shapes the shank portion 20 and the socket portion 22 with the bore 40. Over the main part of its length, the region 21', from which the compliant region 21 is formed, is of cylindrical shape with a diameter of 1.12mm. At the lower end of the region 21', there is a short tapering region 29', 0.43 mm long, from which the tapering ends 29 of the edge portions 28 are formed. At the lower end of the tapering region 29' there is second region 24' that tapers more steeply and is 0.72 mm long. It is from this region 24' that the entry region 24 is formed.

Figure 5:
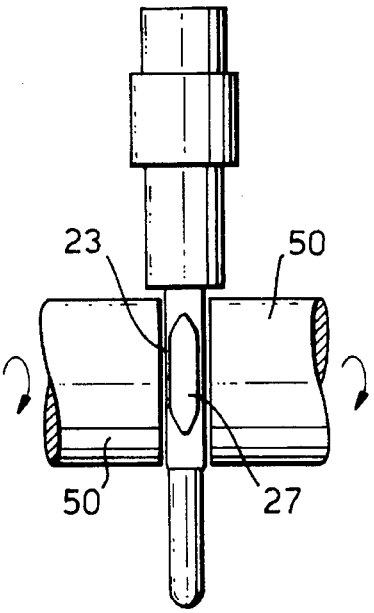
FIGS. 5 are side elevation views of the contact at later stages of manufacture and 6 than that shown in FIG. 4.

The next step in the manufacturing operation, as shown in FIG. 5, is to machine the two flat sides 23 with a tool 50. The flat surfaces 27 are similarly machined while leaving the narrow edge portions 28 with their convex, turned profiles formed by the turning of the regions 21' and 29'.

Figure 6:
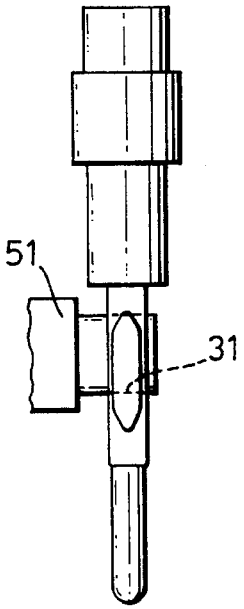

The final step in the manufacturing operation, as shown in FIG. 6, is to stamp out the slot 31 with a die 51.

The finished component can, therefore, be made simply in a few operations.

What I claim is:

1. A compliant contact for insertion in a conductive hole in a circuit board, wherein the contact comprises: a forward shank region, said shank region having a width less than the diameter of said hole; an entry region, said entry region having two opposite convex surfaces tapering away from one another rearwardly, the width of said entry region between said convex surfaces being less than the diameter of said hole at its forward end and being greater than the diameter of said hole at its rearward end; a compliant region having two parallel flat sides, said compliant region being compliant along a part of its length; a slot extending between said two flat sides to divide a part of said compliant region into two resilient blades, said slot extending longitudinally along a part of the compliant region and being spaced rearwardly of the entry region; two planar surfaces, said planar surfaces extending along outer surfaces of respective ones of said blades; and four edge portions, each said edge portion separating one of said planar surfaces from one of said flat sides, and wherein each of said four edge portions has a forward region that tapers outwardly and reduces in width rearwardly, and a rearward region of substantially constant width.

2. A contact according to claim 1, wherein said compliant region has non-compliant portions at opposite ends beyond said slot, and wherein said non-compliant regions are positioned for location within opposite ends of said hole.

3. A contact according to claim 1, wherein said planar surfaces are flat and parallel.

4. A contact according to claim 1, wherein said edge portions form parts of a common surface of circular section.

5. A contact according to claim 1, wherein said slot is rounded at opposite ends.

6. A contact according to claim 1, wherein said contact has a socket portion at an end opposite said shank region.

7. A contact according to claim 6, wherein said socket portion is of a material that can be crimped about a conductor inserted in said socket.

8. A contact according to claim 1, wherein said contact is machined from a single piece of metal.

9. A contact according to claim 1, wherein said contact is made of phosphor-bronze.

10. An assembly comprising a circuit board with a hole having a conductive surface through its depth and a compliant contact inserted in said hole, wherein said contact comprises: a forward shank region, said shank region having a width less than the diameter of said hole; an entry region, said entry region having two opposite convex surfaces tapering away from one another rearwardly, the width of said entry region between said convex surfaces being less than the diameter of said hole at its forward end and being greater than the diameter of said hole at its rearward end; a compliant region having two parallel flat sides, said compliant region being compliant along a part of its length; a slot extending between said two flat sides to divide a part of said compliant region into two resilient blades, said slot extending longitudinally along a part of the compliant region and being spaced rearwardly of the entry region; two planar surfaces, said planar surfaces extending along the outer surface of respective ones of said blades; and four edge portions, each said edge portion separating one of said planar surfaces from one of said flat sides, and wherein each of said four edge portions has a forward region that tapers outwardly and reduces in width rearwardly, and a rearward region of substantially constant width.

11. An assembly according to claim 10, wherein length of said slot is less than the thickness of said board, and wherein said compliant region has non-compliant portions at opposite ends located in opposite ends of said hole.

* * * * *